US006382388B1

(12) United States Patent
Hirai et al.

(10) Patent No.: US 6,382,388 B1
(45) Date of Patent: May 7, 2002

(54) PASSENGER CONVEYER APPARATUS

(75) Inventors: Masaaki Hirai, Tokyo; Yoshio Ogimura, Saitama-ken; Kazuhisa Hara, Tokyo; Takayuki Kikuchi, Saitama-ken, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/695,310

(22) Filed: Oct. 25, 2000

(30) Foreign Application Priority Data

Oct. 25, 1999 (JP) ..... 11-302398
Aug. 11, 2000 (JP) ..... 2000-243983

(51) Int. Cl.[7] ..... B66B 23/12
(52) U.S. Cl. ..... 198/332
(58) Field of Search ..... 198/332, 333

(56) References Cited

U.S. PATENT DOCUMENTS 5,890,578 A * 4/1999 Kwon ..... 198/332
5,924,544 A * 7/1999 Kwon ..... 198/332
6,016,902 A * 1/2000 Kwon ..... 198/332

FOREIGN PATENT DOCUMENTS

GB 2235428 * 3/1991 ..... 198/332
JP 2-243489 9/1990
JP 11-222370 8/1999
WO 99-52808 10/1999

* cited by examiner

*Primary Examiner*—Joseph E. Valenza
(74) *Attorney, Agent, or Firm*—Oblon, Spivak, McClelland, Maier & Neustadt, P.C.

(57) ABSTRACT

A passenger conveyer apparatus including a plurality of steps connected to each other in an endless loop, traveling on a forward path, a backward path and a pair of turning paths connecting between opposite ends of the forward path and the backward path. Each of the steps comprising a step tread and first and second guide rollers offset from each other in the traveling direction of the steps. The apparatus also includes a forward rail configured to guide the first and the second guide rollers in the forward path, a backward rail configured to guide the first and the second guide rollers in the backward path, and a pair of turning rails having a curving rail formed in an arc, configured to guide the second guide roller in the turning paths. At least one of the turning rails is formed in a manner such that a line segment drawn between an orbital center of a corresponding curving rail and a first center of the first guide roller makes an acute angle with a line segment drawn between the orbital center and a second center of the second guide roller, and a loci made by respective turning motions of front and rear edges of the step tread cross each other.

10 Claims, 9 Drawing Sheets

PASSENGER CONVEYER APPARATUS

CROSS REFERENCE TO RELATED APPLICATION

This application claims benefit of priority to Japanese Patent Application Nos. JP11-302398 filed Oct. 25, 1999 and JP2000-243983 filed Aug. 11, 2000, the entire disclosures of which are incorporated by reference herein.

BACKGROUND OF THE INVENTION

1. Field of the Invention

This invention relates to a passenger conveyer apparatus having a plurality of steps connected to each other in an endless loop that conveys passengers, and more particularly to a passenger conveyer apparatus that may shorten the depth measurement of a main frame, which is partly laid under a floor of a building, of the passenger conveyer apparatus. In this specification, the word "step" is used to have the broad meaning that includes so-called pallets.

2. Description of the Background

In recent years, with the advent of aging society, it has been discussed whether escalators and moving walkways should be installed in several kinds of facilities. The escalator is one example of a passenger conveyer apparatus that has a plurality of steps like stairs and is installed between upper and lower floors. The moving walkway is another example of a passenger conveyer apparatus that has a plurality of steps or pallets forming a plane surface which conveys passengers.

Public facilities for transportation, such as a train station particularly, promote the installation of such passenger conveyer apparatuses. Most of the train stations mainly promote the installation of escalators because the building of the train station needs to convey people in a condition that passenger paths cross train paths.

FIG. 1 is a side view of a conventional escalator 51. Escalator 51 has a main frame 52, which includes an upper frame 52*a*, a lower frame 52*b* and a middle frame 52*c*. The escalator 51 is bridged in a building 54 by support frames 53*a* and 53*b* that are secured to opposite ends of the main frame 52. In FIG. 1, a symbol "A" represents a depth measurement of the upper frame 52*a*, a symbol "B" represents a depth measurement of the lower frame 52*b*, and a symbol "C" represents a depth measurement of the middle frame 52*c*.

In general, in the case that the escalator 51 is installed in an existing building for a train station, stairs 55 are already set in the passenger path. In some cases, there is no space to install the escalator 51 in a different place from the stairs 55, or the escalator 51 may not function as the passenger path practically even if there is a space to install the escalator 51 in a different place from the stairs 55. Therefore, the escalator 51 is often installed along the stairs 55 after pulling down and altering a part of the stairs 55, a platform 57, and/or a concourse. Further, a roof 56 is usually set above the stairs 55, In the case that the escalator 51 is installed along the stairs 55, it is required to keep a regulation clearance of "K" below the ceiling 56. Therefore, an opening is generally excavated in the stairs 55 and the platform 57 in order to put the main frame 52 therein. Hatching portions "H" in FIG. 1 are portions to be excavated for the opening.

The depth measurement A of the upper frame 52*a* and the depth measurement of B of the lower frame 52*b* depend mainly on a depth of a space for putting a turning system for the steps of the escalator 51. FIG. 2 is a side view showing the upper frame 52*a*. As shown in FIG. 2, steps 60 are connected to each other in an endless loop and drawn by step chains 61 (only one is shown). Each of the steps 60 has a pair of first guide rollers 62 and a pair of second guide rollers 63. The first guide rollers 62 and the second guide rollers 63 are guided by a pair of first guide rails 65 and a pair of second guide rails 66 respectively. Since the first guide rollers 62 are disposed at left and right sides of the step 60, only one side of the first guide rollers 62 is shown in FIG. 2. Likewise, since the second guide rollers 63 are disposed at the right and left sides of the step 60, only one side of the second rollers 63 is shown in FIG. 2, Moreover, a portion of the second roller 63, is hidden in FIG. 2, and only one side of the first guide rails 65 and second guide rails 66 is shown.

A pair of step chain sprockets 64 is set in the upper frame 52*a* and disposed at the right and left sides of the step 60 in order to turn the steps 60 over. The step chains 61 are placed around the step chain sprockets 64 respectively. The step chain sprockets 64 are connected together by a sprocket axle 64*a*. The adjacent steps 60 come close to each other at the time that the steps 60 are turned over by the step chain sprockets 64. Accordingly, it is required to secure a clearance of "D" shown in FIG. 2 in order to avoid interference between the respective adjacent steps 60. Therefore, a radius of the step chain sprocket 64 may not be reduced easily. Consequently, it is difficult to reduce the depth measurement of the upper frame 52*a*.

The second guide rollers 63 of the step 60 are disposed below a riser 60*b* of the step 60. Accordingly, the height of the step 60 is determined by at least the sum of a height of the riser 60*b* and a height of the second guide rollers 63. Further, since the second guide rollers 63 are guided by the second guide rails 66 and turn around the sprocket axle 64*a*, it is needed to secure a space more than the sum of a diameter of the sprocket axle 64*a* and double the thickness of the second guide rails 66 between a forward side (upper side) and a backward side (lower side) of the second guide rails 66.

The lower frame 52*b* has the substantially same structure as the upper frame 52*a*. Accordingly, the depth measurement of B of the lower frame 52*b* is determined in the same way as the depth measurement of A of the upper frame 52*a*.

The depth of C of the middle frame 52*c*, as shown in FIG. 3, relies mainly on a depth of a space for putting a guide system for the steps 60 of the escalator 51. FIG. 3 is a side view of the middle frame 52*c*. To put it in detail, the depth of C of the middle frame 52*c* is determined by the height of the riser 60*b*, a diameter of the second guide rollers 63 and a size of a crossbeam 67 secured to the middle frame 52*c* in the right and left direction against the moving direction of the steps 60.

As described above, in the case that the escalator 51 is installed in an existing building for a train station that has already been built and operated, a lot of costs and time are required to alter a part of the building and to temporarily take some obstructions apart. That is, in case that the escalator 51 is installed along the existing stairs 55, it is required that large openings for putting the main fame 52 of the escalator 51 be excavated in the stairs 55 and the platform 57, thereby greatly increasing a construction cost. If a strengthening material exists under the stairs 55, it is required that the strengthening material be removed and then another strengthening material be newly added, thereby increasing construction costs in most cases. Further, as the building needs massive alteration, a term of the construction extends over a long period of time. In the in station that remains operated, it is needed to take more precautions by separating the construction area, thereby causing inconvenience to users. As a result, the loss to the train station increases.

Japanese patent publication (Kokai) No. 2-243489 discloses a way to reduce the depth measurement of a main frame as explained by using FIG. 4. As shown in FIG. 4, at the time that the step 60 starts to turn over by the step chain sprockets 64, the rear edge 60*p* of the step 60 makes a locus 72 that transiently overhangs upward. Accordingly, it is required that the height of a floor 73 be determined so as to secure a space for avoiding interference between the steps 60 and the floor 73. According to the above-mentioned JP '489, the escalator 51 includes lower rails 70*a* and 71*a* at a part of each guide rail 65 and 66 respectively for guiding the first guide rollers 62 and the second guide rollers 63 respectively. The steps 60 move downward along the lower rails 70*a* and 71*a* before the steps 60 reach to the step chain sprocket 64. As a result, it is not needed to raise the height of the floor 73 in order to avoid the interference between the rear edge 60P and the floor 73.

It is thought that the depth of the upper frame 52*a* may be reduced by providing the lower rails 70*a* and 71*a*, because lowering the height of the floor 73 lowers the depth of the upper frame 52*a*. However, the present inventors have attempted to reduce the depth of the upper frame 52*a* by using lower rails 70*a* and 71*a* and simply reducing a radius of gyration of the steps 60. The structure of the inventors' efforts is shown in FIG. 5. According to the structure shown in FIG. 5, the depth of H2 of the upper frame becomes lower compared to the depth of H1. However, this structure causes problems in the upper frame.

For example, it is assumed that the steps 60 turn over clockwise in FIG. 5. In this case, the first guide roller 62*a* of the step 60*a*, which is now turning over as shown in FIG. 5, is driven clockwise by a force of "F" produced by the step chain sprockets 64. At this time, the second guide roller 63*a* of the step 60*a* needs to move to the right until the turning area. That is, a force of "f" is needed to move the second roller 63*a* to the right. However, the second guide roller 63*a* is dependent on the first guide roller 62*a* That is, the second guide roller 63*a* moves by a moving force, which applies to the first guide roller 62*a*, given by the step chain sprockets 64. Accordingly, since the force "F" does not include a constituent of the moving force "f", the step 60*a* stops at this position. In the final analysis, the present inventors have discovered that the depth of the upper frame may not lower by simply reducing a radius of gyration of the steps 60 with the use of the lower rails 70*a* and 71*a* disclosed in JP '489.

SUMMARY OF THE INVENTION

Accordingly, one object of this invention is to provide a passenger conveyer apparatus that may reduce the depth of the main frame.

Another object of this invention is to provide a passenger conveyer apparatus that may reduce installation costs thereof.

The present invention provides a passenger conveyer apparatus, including a plurality of steps, connected to each other in an endless loop, traveling on a forward path, a backward path and a pair of tuning paths connecting between opposite ends of the forward path and the backward path, each of the steps having a step bead, a first guide roller, and a second guide roller disposed apart from the first guide roller in the moving direction of the steps, a step chain coupled to the first guide roller and placed around a step chain sprocket disposed in one of the turning paths, a drive unit configured to drive the step chain sprocket and to circulate the steps, a forward rail configured to guide the first guide roller and the second guide roller in the forward path, a backward rail configured to guide the first guide roller and the second guide roller in the backward path, and a pair of turning rails, configured to guide the second guide roller in the turning paths and connected between opposite ends of the forward rail and the backward rail, having a curving rail formed in a semicircle, at least one of the turning rails forming in a mower such that a line segment drawn between the orbital center of the curving rail and the first center of the first guide roller makes an acute angle with a line segment drawn between the orbital center and the second center of the second guide roller, and that loci made by respective turning motions of front and rear edges of the step tread cross each other.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 6:
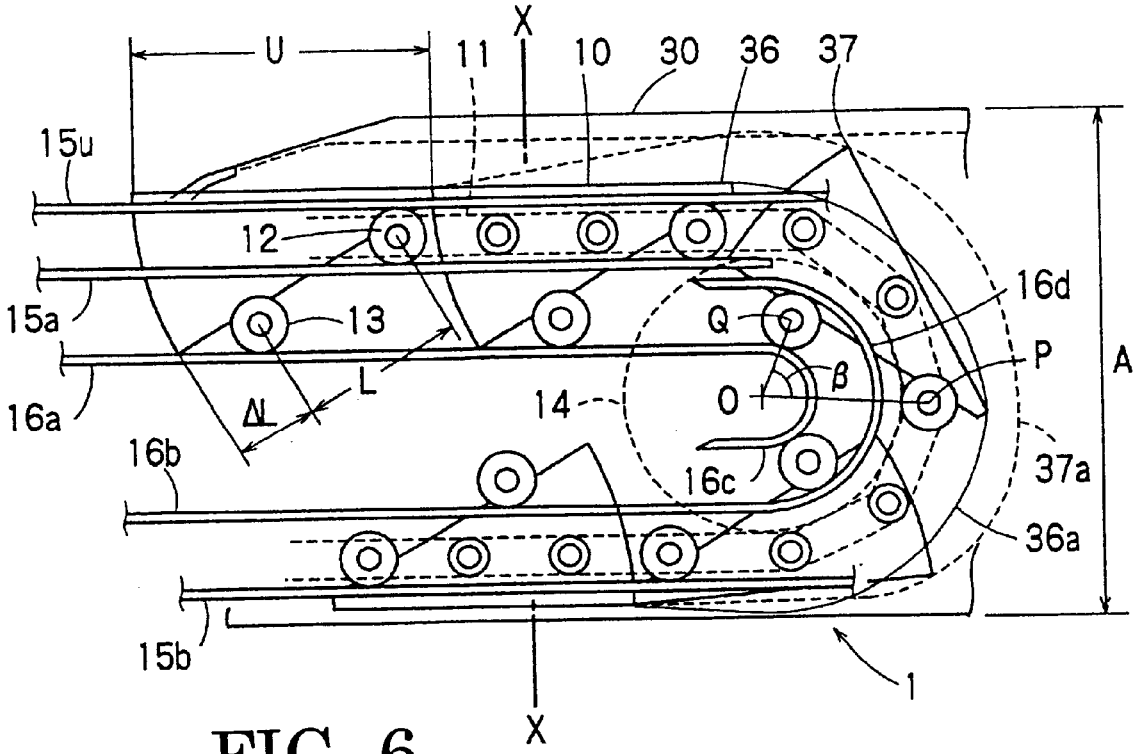
FIG. 6 is a side view of an upper frame portion of a passenger conveyer apparatus of a first embodiment of the present invention.
Figure 7:
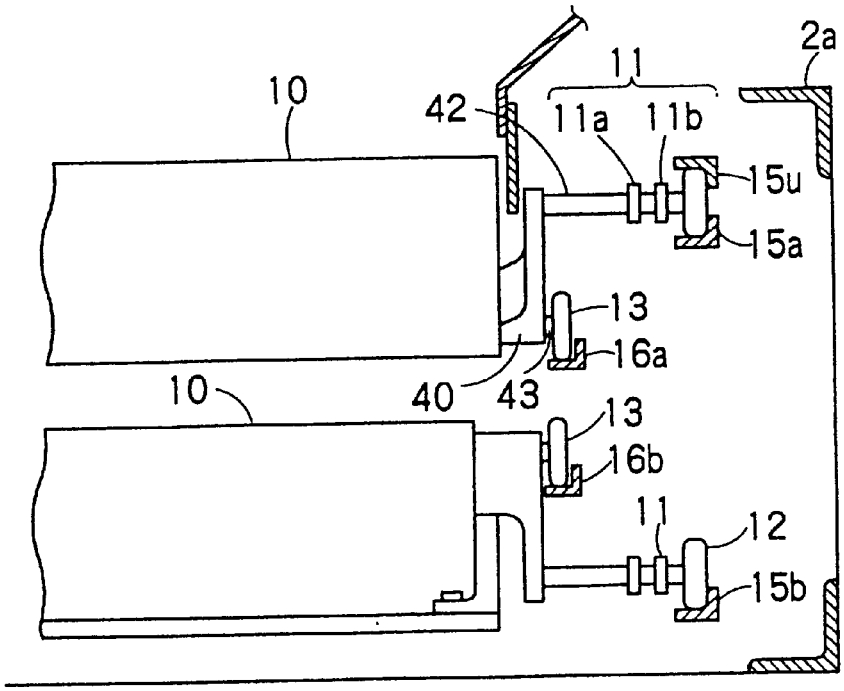
FIG. 7 is a cross-sectional view taken on line X—X of FIG. 6.
Figure 8:
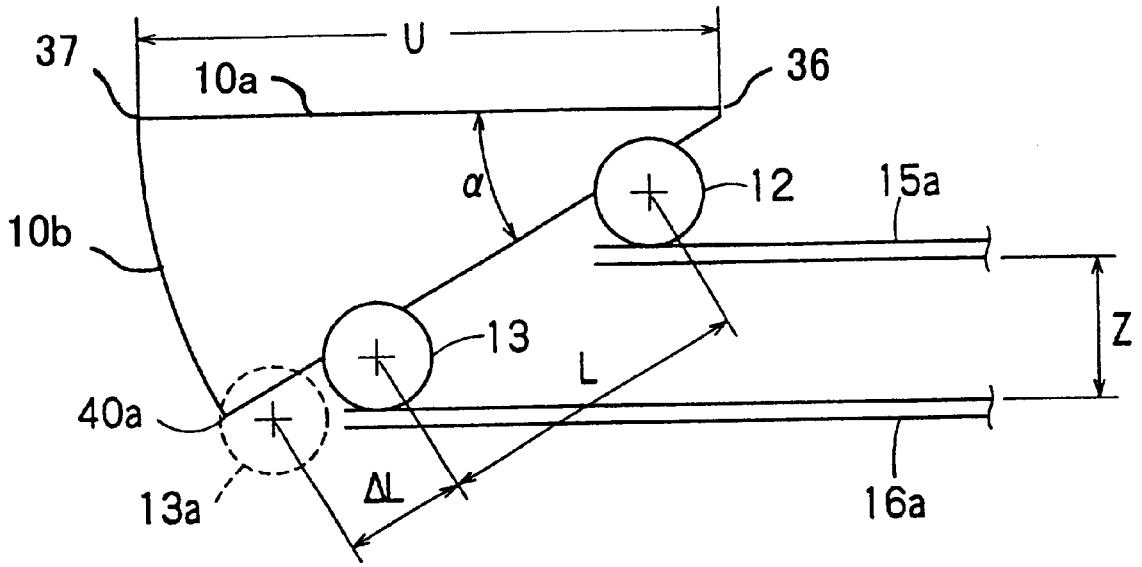
FIG. 8 is a side view of a step in FIG. 6.
Figure 9:
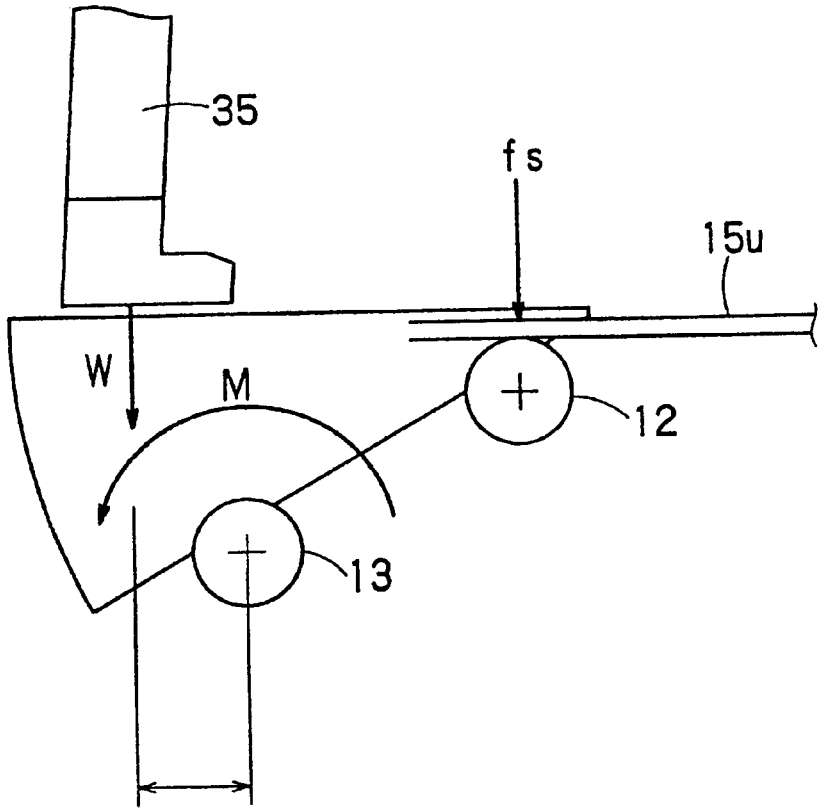
FIG. 9 is an illustrative diagram showing a load operating on the step in FIG. 8.

The present invention is hereinafter described in detail by way of illustrative embodiments of escalators. FIG. 6 is a side view of an upper fame portion of a passenger conveyer apparatus of a first embodiment of the present invention. FIG. 7 is a sectional view taken on line X—X of FIG. 6. FIG. 8 is a side view of a step in FIG. 6. FIG. 9 is an illustrative diagram showing a load operating on the step in FIG. 8.

As shown in FIG. 6 through FIG. 9, the passenger conveyer apparatus 1 has a plurality of steps 10, which are connected to each other in an endless loop, traveling clockwise on a forward path disposed in an upper side of the passenger conveyer apparatus 1, a backward path disposed in a bottom side of the passenger conveyer apparatus 1, and a pair of turning paths connecting between opposite ends of the forward path and the backward path. Two support plates 40 are secured to the right and left sides of the lowest portion of he step 10 (Only one side is shown in FIG. 7).

Each of the support plates 40 includes a first guide roller support 42 disposed at the front side of the step 10 and a second guide roller support 43 disposed at the rear side of the step 10. A first guide roller 12 is pivotably connected to the first guide roller support 42. A second guide roller 13 is pivotably connected to the second guide roller support 43. The second guide roller 13 is disposed close to the support plate 40, while the first guide roller 12 is disposed apart from the support plate 40. The second guide roller 13 and the first guide roller 12 are on the different levels from each other. Two link plates 11*a* and 11*b*, which composes a step chain 11, are pivotably connected to the first guide roller support 42.

In this embodiment, as shown in FIG. 8, a distance between the center of the first guide roller 12 and the center of the second guide roller 13 is shortened by a length of ΔL compared to a conventional step. As a result the distance "L" is about half a distance "U" between a front edge 36 and a rear edge 37 of the step 10. In this case, the bottom of the second guide roller 13 is level with the lower end 40*a* of the step 10, that is the lower end of a riser 10*b*, in a condition that a step tread 10*a* of the step 10 forms a horizontal plane. The second guide roller 13*a* of the conventional step is indicated in a dashed line in FIG. 8 for reference.

As shown in FIG. 6 through FIG. 9, a pair of first forward guide rails 15*a* for guiding the bottom of the first guide rollers 12 and a pair of second forward guide rails 16*a* for guiding the bottom of the second guide rollers 13 are installed in the forward path in the same way as the conventional escalator. A pair of first backward guide rails 15*b* for guiding the bottom of the first guide rollers 12 and a pair of second backward guide rails 16*a* for guiding the bottom of the second guide rollers 13 are installed in the backward path. In FIG, 6, only one side of the first forward guide rails 15*a* is shown. Likewise, only one side of the second forward guide rails 16*a* is shown in FIG. 6. The other sides of the first and second guide rails 15*a* and 16*a* are hidden in FIG. 6.

Further, a pair of first upper guide rails 15*u* for guiding the upper sides of the first guide rollers 12 is installed in the forward path, The first forward guide rails 15*a*, the first upper guide rails 15*u* and the second forward guide rails 16*a* are disposed at both right and left sides of an orbit of the step 10 so as to guide the respective first and second guide rollers 12 and 13. Likewise, a pair of first backward guide rails 15*b* and a pair of second backward guide rails 16*b* are disposed at both right and left sides of an orbit of the step 10 so as to guide the respective first and second guide rollers 12 and 13.

In each of the turning paths positioned between the opposite ends of the forward path and the backward path, a tug system that turns the steps 10 over and changes the moving direction of the steps 10 by guiding the first guide roller supports 42, that is a part of the step 10, is installed. The turning systems may guide the first guide rollers 12 directly instead of the first guide roller support 42.

As shown in FIG. 6, one of the turning systems includes a pair of step chain sprockets 14 rotating and supporting the first guide roller supports 42 on pitch circles thereof. Each of the step chain sprockets 14 is a disk that has tooth spaces on the periphery thereof for supporting a part of the first guide roller supports 42 that is the part between the link plates 11*a* and 11*b*. The step chain sprocket 14 may be composed of a sprocket wheel that directly drives the step chain 11, or a toothed wheel that drives connecting shafts of the step chain 11. A drive unit for driving the step chain sprockets 14 may be composed of a toothed gear system, or a cam and a sprocket wheel system.

The circumference of the pitch circle of the step chain sprocket 14 is multiples of a pitch of the first guide roller support 42, which is equal to the pitch of the first guide roller 12. Accordingly, the step chains 11 draw the steps 10 by the rotation of the step chain sprockets 14, thereby circulating the steps 10. The step chain sprockets 14 are disposed at both right and left sides of an orbit of the step 10 so as to support the first guide roller supports 42.

Turing guide rails 16*c* and 16*d*, which are formed in a semicircle, for guiding the respective bottom and upper sides of the second rollers 13 are disposed in the turning path. The turning guide rails 16*c* and 16*d* are coupled to the respective ends of second forward guide rails 16*a* and first backward guide rails 16*b*. In case that the second guide rollers 13 are guided along the semicircular orbit by means of the turning guide rails 16*c* and 16*d*, the step 10 may stop in the turning path if a radius of the semicircular orbit reduces as described above referring to FIG. 5. Therefore, as shown in FIG. 6, the turning guide rails 16*c* and 16*d* are formed in a manner such that a line segment drawn between the orbital center "O" of the turning guide rails 16*c* and 16*d* and the center "P" of the first guide rollers 12 makes an acute angle (<POQ) with a line segment drawn between the orbital center O and the center "Q" of the second guide rollers 13.

In this embodiment, the distance L between the center of the first guide rollers 12 and the center of the second guide rollers 13, and a radius of gyration of the turning guide rails 16*c* and 16*d* are determined so Bat Me angle 3 becomes less than an angle of 90 degrees. Preferably, the distance "L" is set to become half the distance "U" between the front edge 36 and the rear edge 37 of the step 10. Further, the second guide rollers 13 are disposed forward toward the rear edge 37.

Further, in one side of the ting systems shown in FIG. 6, the turning guide rails 16*c* and 16*d* are formed in a manner such that the rear edge 37 travels outside a locus 36*a* of the front edge 36 in a forward side section (upper side section) of the turning path, and travels inside the locus 36*a* in a backward side section (lower side section) of the turning path. That is, the loci 36*a* and 37*a* made by the respective turning motions of front and rear edges 36, 37 of the step tread 10*a* cross each other in the backward side section of the turning paths Furthermore, as shown in FIG. 8, since the distance L between the center of the fist guide rollers 12 and the center of the second guide rollers 13 shortens by ΔL, a distance "Z" between the first forward guide rails 15*a* and the second forward guide rails 16*a* reduces.

Figure 1:
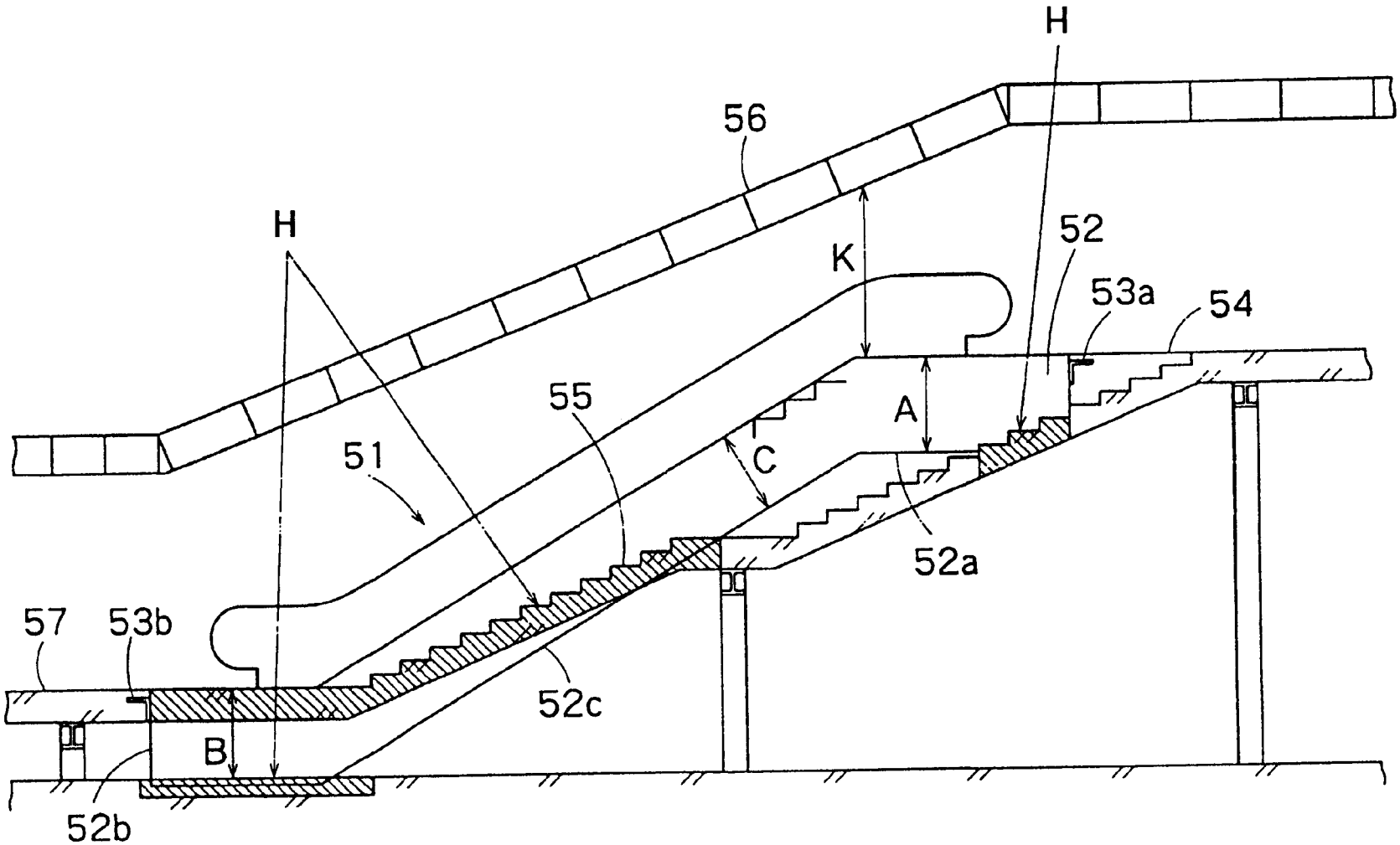
FIG. 1 (PRIOR ART)
FIG. 1 is a side view of a conventional escalator.
Figure 2:
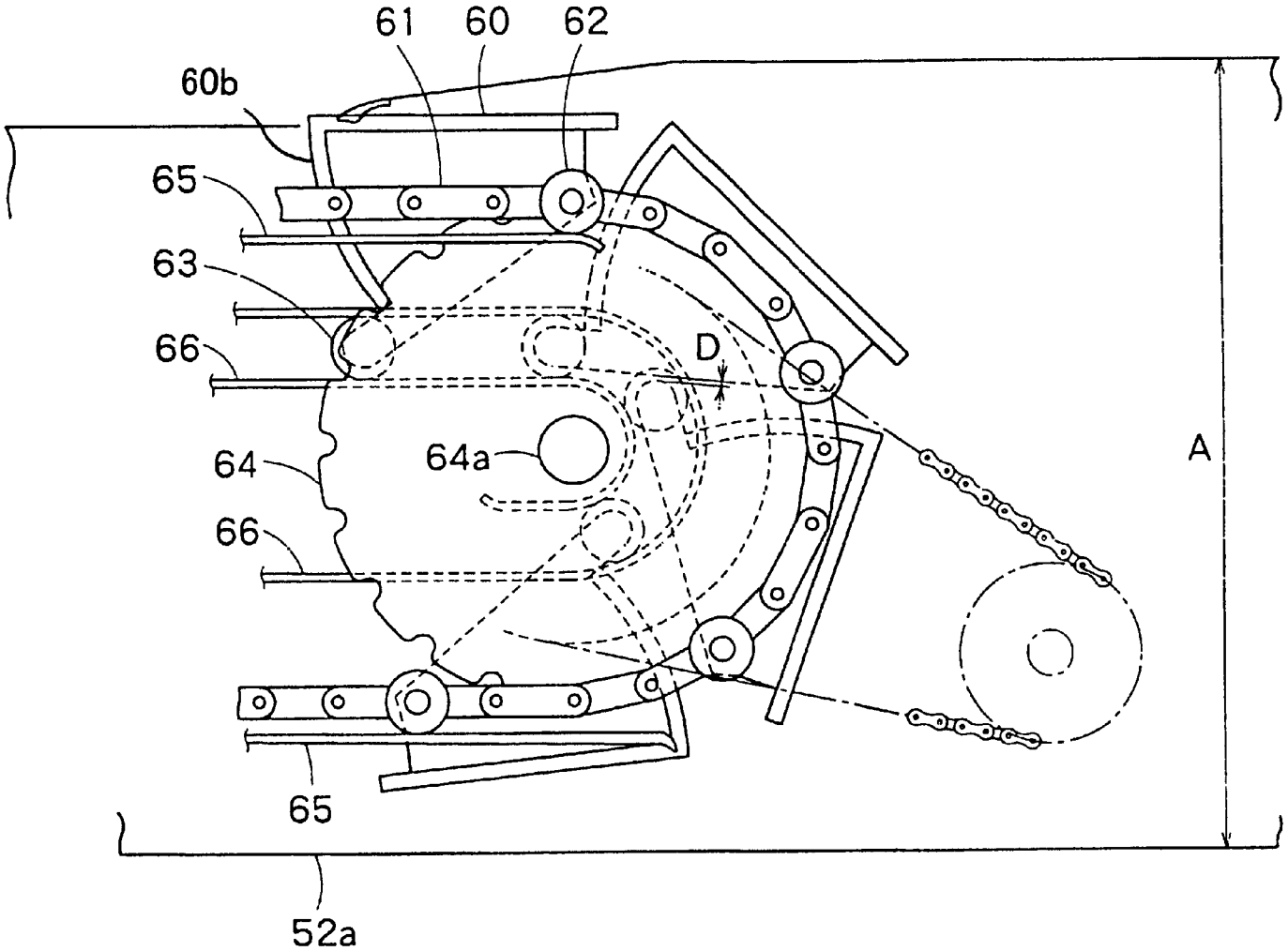
FIG. 2 (PRIOR ART)
FIG. 2 is a side view showing the upper fame of the conventional escalator.
Figure 3:
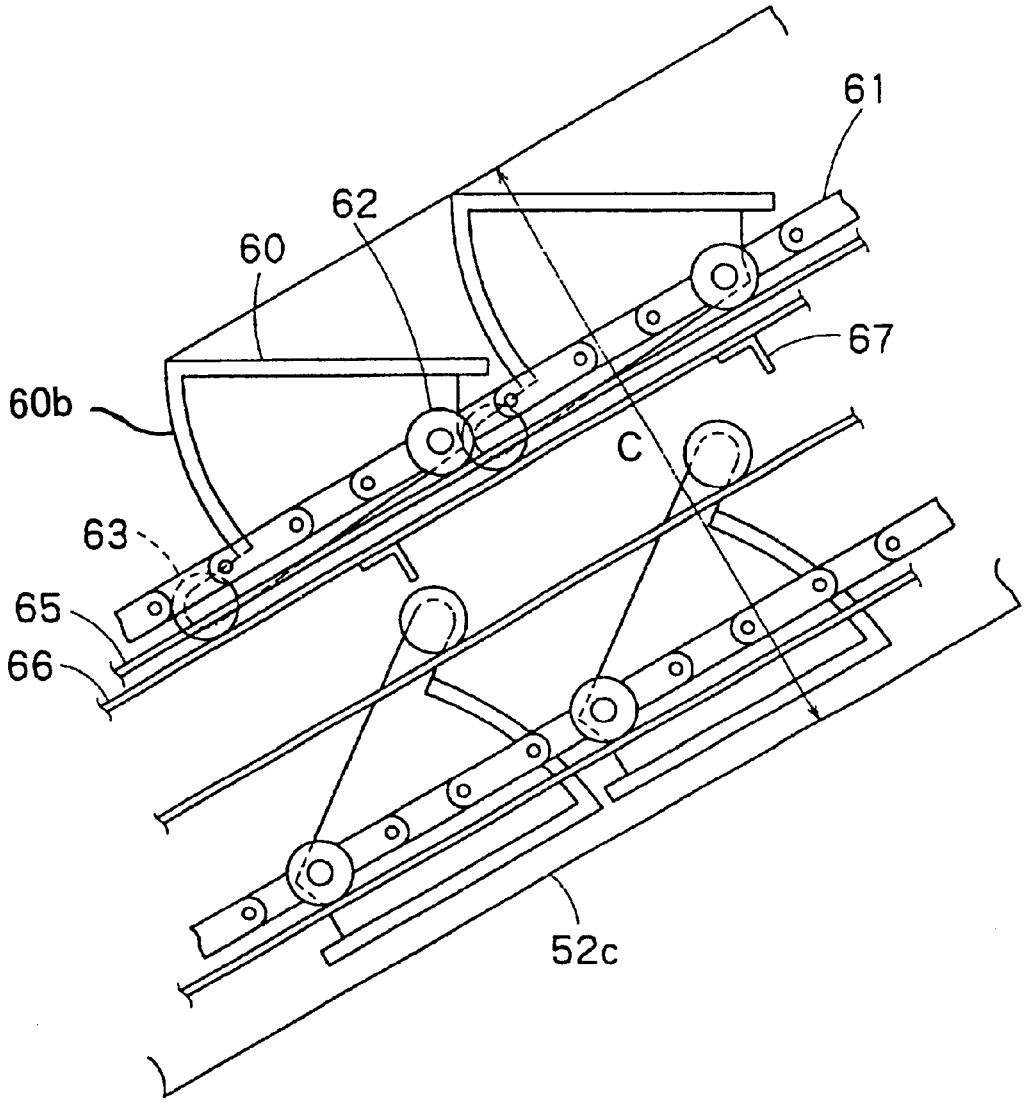
FIG. 3 (PRIOR ART)
FIG. 3 is a side view of the middle frame of the conventional escalator.
Figure 4:
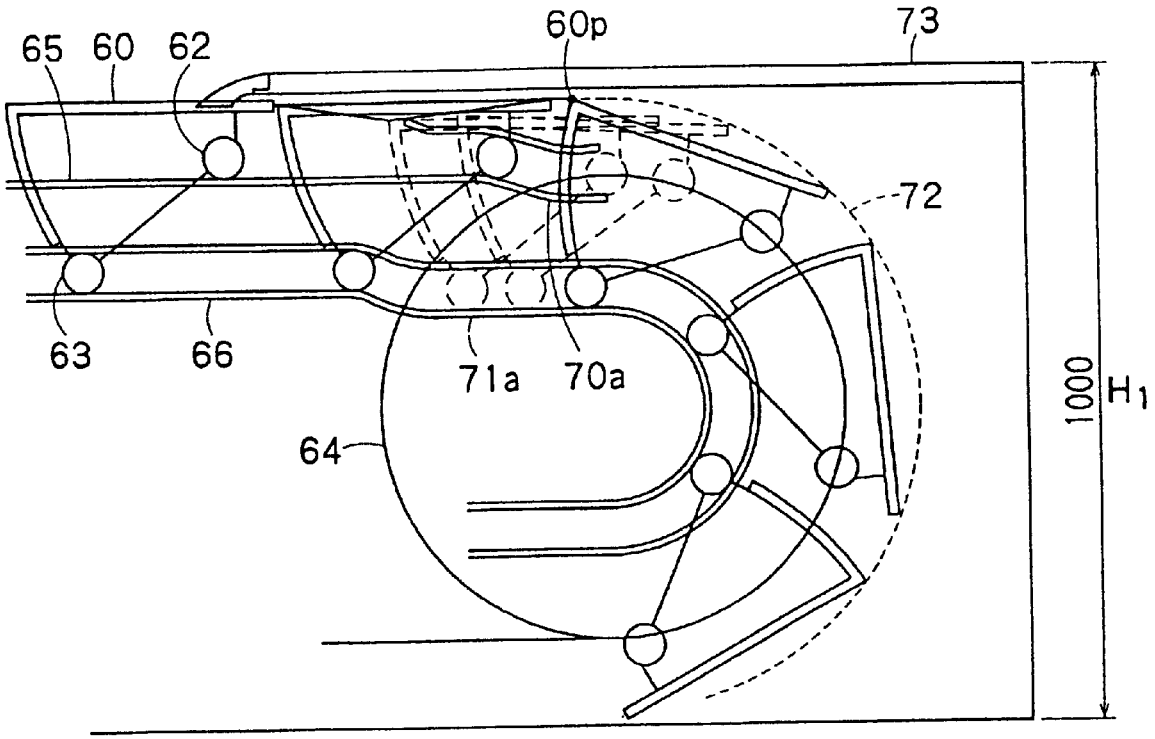
FIG. 4 (PRIOR ART)
FIG. 4 is a side view of the upper frame of the conventional escalator disclosed it Japanese patent publication (Kokai) No, 2-243489.
Figure 5:
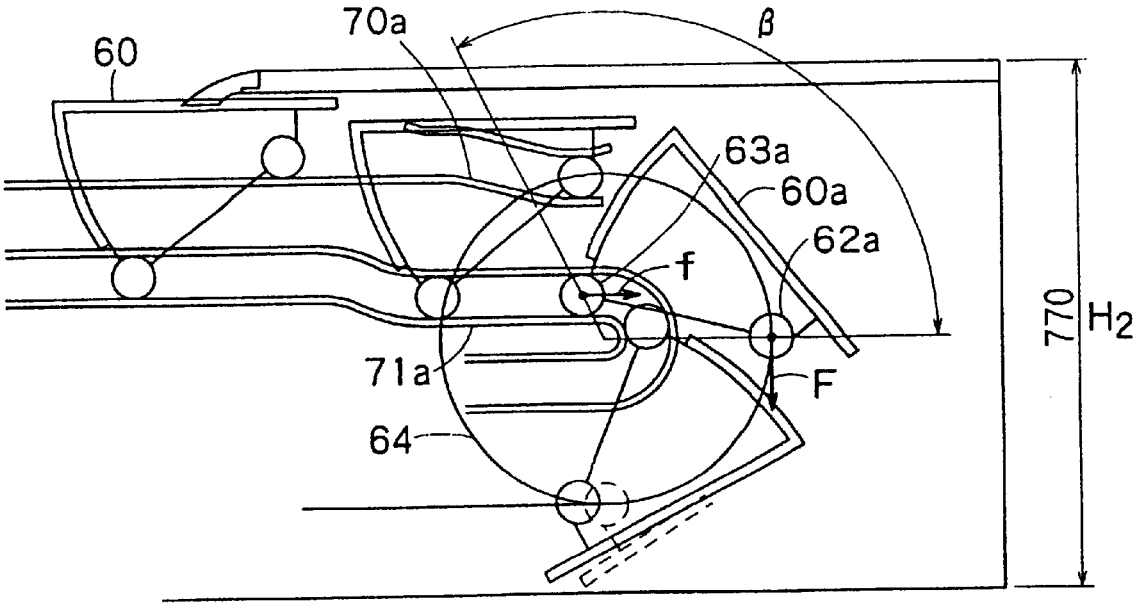
FIG. 5 is a side view of the upper frame of an illustrative escalator.

Since the second guide rollers 13 are disposed forward toward the rear edge 37, the rear edge 37 of the step 10 makes a locus that transiently overhangs upward more than the conventional step at the time that the step 10 starts to turn over as described with respect to FIG. 5 above. Accordingly, the height of a floor 30 is raised to avoid interference with the steps 10, and an enough space for putting the turning system in is secured below the floor 30. However, such height may be sufficiently offset by reducing the distance L and a radius of gyration of the turning guide rails 16*c* and 16*d*.

The respective edges of the first forward guide rails 15*a*, the first upper guide rails 15*u*, the first backward guide rails 15*b* and the turning guide rails 16*c* and 16*d* are chamfered to restrain vibration and noise generated at the time that the steps 10 enter and leave the respective rails.

An operation of the above-mentioned conveyer apparatus is hereinafter described. The steps 10 circulate in the conveyer apparatus by the corresponding rails that guide the first and second guide rollers 12 and 13. That is, the first forward guide rails 15*a*, the first upper guide rails 15*u* and the second forward guide rails 16*a* guide the first and second guide rollers 12 and 13 in the forward path. The first backward guide rails 15*b* and the second backward guide rails 16*a* guide the first and second guide rollers 12 and 13 in the backward path. In each of the turning pats, each of the turning systems drives the first guide roller supports 42 (i.e. the first guide rollers 12). In one side of the turning paths, as the step chain sprockets 14 rotate, the first guide roller supports 42 supported by the tooth space of the step chain sprockets 14 rotate. At this time, the turning guide rails 16*c* and 16*d* guide the second guide rollers 13. Accordingly, a posture of the step 10 is controlled by the first guide roller supports 42 and the turning guide rails 16*c* and 16*d*.

The rear edge 37 of the step 10 makes a locus that transiently overhangs more upward compared to the conventional step at the time that the step 10 starts to turn over. However, since enough space is secured below the floor 30 by raising the height of the floor 30, the steps 10 may not interfere with the floor 30.

Further, in one side of the turning systems shown in FIG. 6, the rear edge 37 travels outside a locus 36*a* of the front edge 36 in a forward side section (upper side section) of the tug path, and travels inside the locus 36*a* in a backward side section (lower side section) of the tuning path. That is, the step 10 turns over in the turning path so that the loci 36*a* and 37*a* made by the respective turning motions of the front and rear edges 36 and 37 of the step tread 10*a* cross each other in the backward side section of the turning pat, Likewise, in the other side of the turning system (not shown), the rear edge 37 travels outside a locus 36*a* of the front edge 36 in a backward side section (lower side section) of the turning path, and travels inside the locus 36*a* in a forward side section (upper side section) of the turning path. That is, the step 10 turns over in the turning path so that the loci 36*a* and 37*a* made by the respective turning motions of the front and rear edges 36 and 37 of the step tread 10*a* cross each other in the forward side section of the turning path. Accordingly, the locus 37*a* of the rear edge 37 is made thinner and a radius of gyration of the steps 10 reduces.

The step chains 11 transmit driving forces received from the step chain sprockets 14 to the all steps 10 and draw the steps 10, thereby circulating the steps 10. In the turning system since the angle is kept to be an acute angle, the steps 10 may not be locked. Further, since the respective edges of rails 15*a*, 15*u*, 15*b*, 16*c* and 16*d* are chamfered, unpleasant vibration and noise generated at the time that the steps 10 enter and leave the respective rails may be restrained effectively.

In this embodiment, as shown in FIG. 9, a moment "W" that operates to turn the step 10 backward may be produced by the weight "W", when a passenger 35 steps on the step 10. However, a support force "fs" of the first upper guide rails 15*u* receives the moment M, thereby preventing the step 10 from turning backward.

According to the first embodiment, the steps turn over in the turning paths so that the angle B is kept to be an acute angle. Further, the steps 10 turn over in a manner such that the loci 36*a* and 37*a* made by the respective tuning motions of the front and rear edges 36 and 37 of the step tread 10*a* cross each other in the turning paths. Accordingly, a radius of gyration of the steps 10 reduces, thereby lowering the depth of the turning system.

Figure 10:
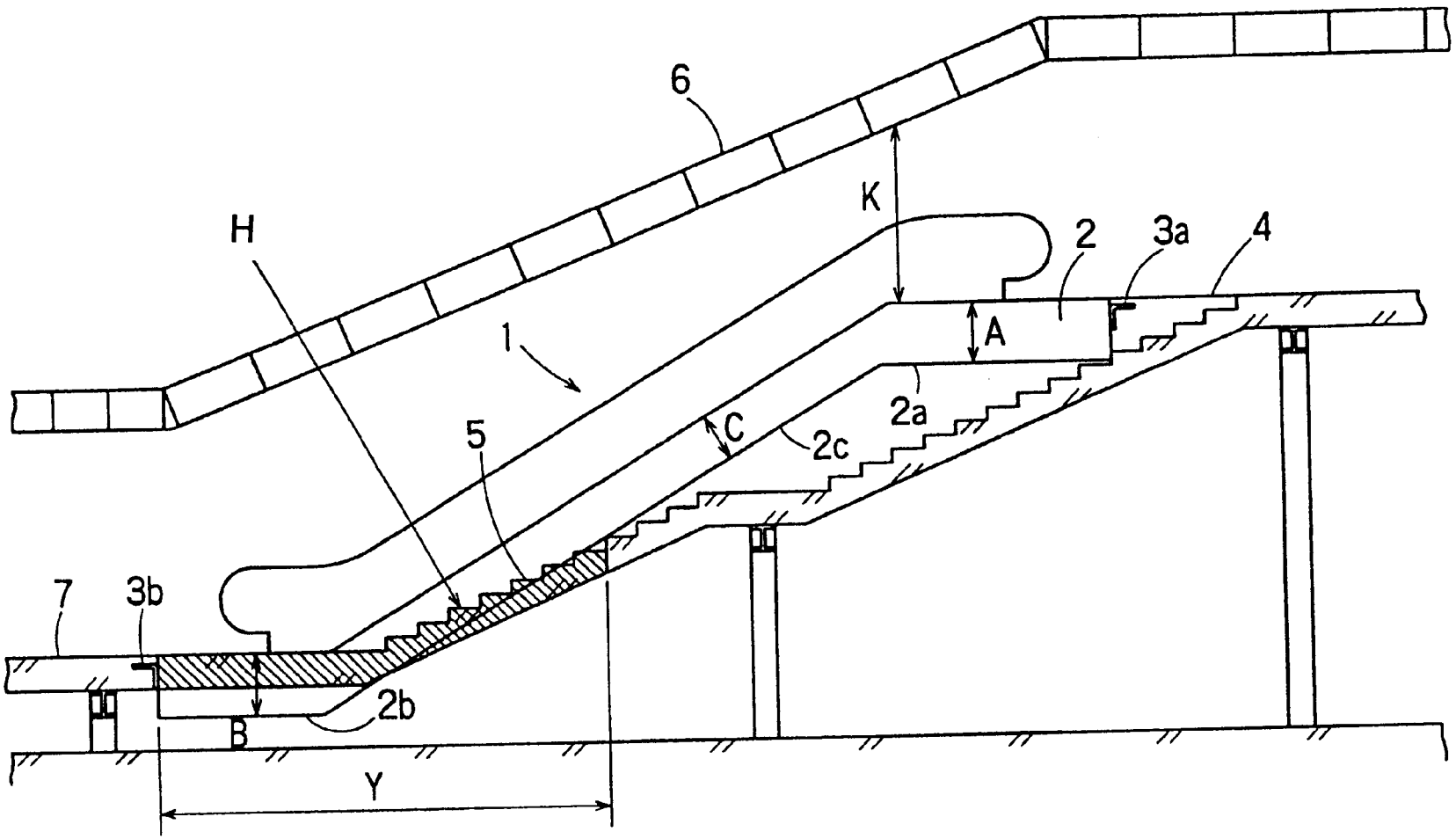
FIG. 10 is an example of installation of the conveyer apparatus that is installed in an existing building for a train station.

FIG. 10 is an example of installation of the conveyer apparatus 1 that is installed in an existing building 4 for a train station, The construction work requires that an opening for putting only lower portion of the main frame 2 of the escalator 1 be excavated at the stairs 5 and the platform 7 in order to secure the regulation clearance of "K" against the ceiling 6, because the depth of the main frame 2 reduces, that is, the respective depth measurements A, B and C of the upper frame 2*a*, the lower frame 2*b* and the middle frame 2*c* reduce. Accordingly, a burden of the construction work on the building may be reduced. Further, since a construction period may shorten, inconvenience to users may be reduced. In FIG. 10, support frames 3*a* and 3*b* are used for securing opposite ends of the main fame 2 to the building 4, Further, since the moment "M" caused by the arrangement of the first and second guide rollers 12 and 13 , and referred to in FIG. 9, is supported by the first upper guide rails 15*u*, the steps 10 may be effectively prevented from turning backward.

Figure 11:
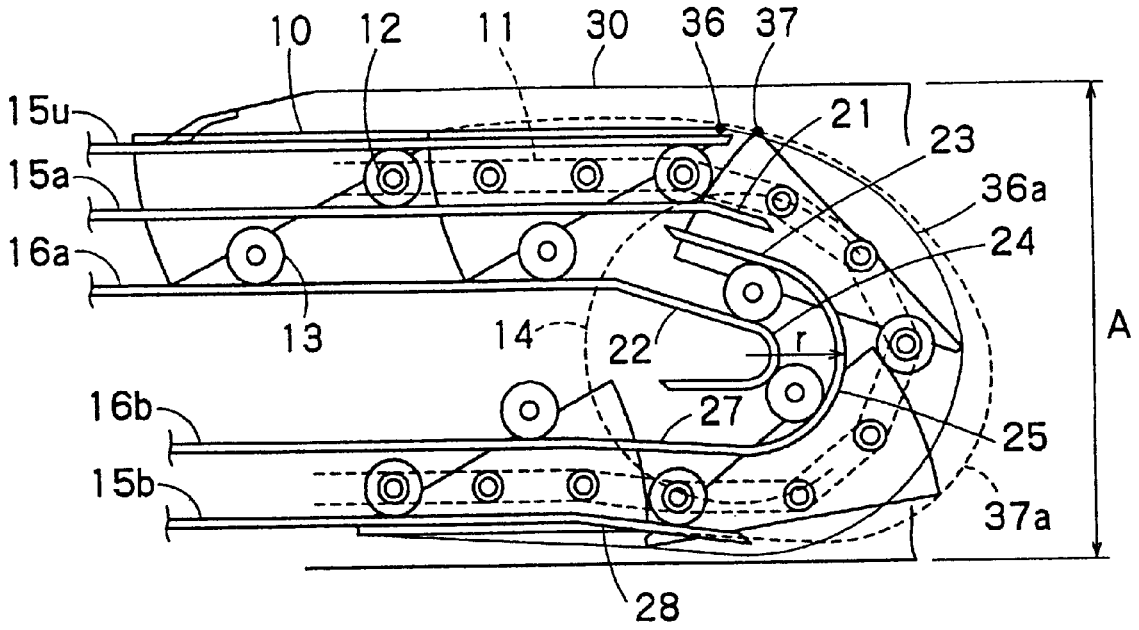
FIG. 11 is a side view of an upper frame portion of the passenger conveyer apparatus of the second embodiment of the present invention.

A second embodiment of a passenger conveyer apparatus is hereinafter described by referring to FIG. 11. FIG. 11 is a side view of an upper frame portion of the passenger conveyer apparatus of the second embodiment of the present invention. As shown in FIG. 11, the conveyer apparatus 1 includes two pairs of curving rails 24 and 25 formed in a semicircle for leading the second guide rollers 13 along the semicircular orbit, a pair of first tilt guide rails 21 for moving the first guide rollers 12 nearer to the orbital center, that is downward, and two pairs of second tilt guide rails 22 and 23 for moving the second guide rollers 13 nearer to the orbital center. In the second embodiment, the rails 21, 22, 23, 24 and 25 are substituted for the turning rails 16*c* and 16*d*.

The rails 21, 22 and 23 are substantially parallel to each other. The second tilt guide rails 22 and 23 guide the respective bottom and upper sides of the second guide rollers 13. The curving rails 24 and 25, which are continuously coupled to the second tilt guide rails 22 and 23, guide the respective bottom and upper sides of the second guide rollers 13 in the same way, In addition, the curving guide rails 25 are coupled to the second backward guide rails 16*a* through a pair of joint rails 27 slanting upward. Furthermore, a pair of supplementary rails 28 slanting upward are fixed to the edges of the first backward guide rails 15*b* for leading the first guide rollers 12 upward, The center of the step chain sprockets 14 is shifted downward against an orbital center of the curving rails 24 and 25 in accordance with the arrangement of the rails 21 through 28.

In one side of the turning systems shown in FIG. 11, the rear edge 37 travels outside a locus 36*a* of the front edge 36 in a forward side section (upper side section) of the turning path, and travels inside the locus 36*a* in a backward side section (lower side section) of the turning path. That is, the step 10 turns over in die turning path so that the loci 36*a* and 37*a* made by the respective turning motions of the front and rear edges 36 and 37 of the step tread 10*a* cross each other in the backward side section of the turning path. Likewise, in the other side of the tuning systems (not shown), the rear edge 37 travels outside a locus 36*a* of the front edge 36 in a backward side section (lower side section) of the turning path, and travels inside the locus 36*a* in a forward side section (upper side section) of the turning path. That is the step 10 turns over in the turning path so that the loci 36*a* and 37*a* made by the respective turning motions of the front and rear edges 36 and 37 of the step tread 10*a* cross each other in the forward side section of the turning path.

The other components of the conveyer apparatus 1 of the second embodiment are the same as the first embodiment in FIG. 6 through FIG. 9. In the second embodiment, a detailed explanation of the corresponding components as the first embodiment is omitted by giving the same numerals to the same components.

According to the second embodiment, since the steps 10 turn over in a manner such that the loci 36*a* and 37*a* made by the respective tuning motions of the front and rear edges 36, 37 of the step tread 10*a* cross each other in the turning paths, a radius of gyration of the steps 10 reduces, thereby lowering the depth of the turning system. Further, since the steps 10 turn over after moving downward, interference between the rear end 37 of the step 10 and the floor 30 may be avoided without raising the height of the floor 30. Moreover, since the distance L between the center of the first guide rollers 12 and the center of the second guide rollers 13 reduces, a radius of gyration of the steps 10 reduces. As a result, the depth "A" of the upper fame of the conveyer apparatus 1 may reduce considerably.

The joint guide rails 27 and the supplementary rails 28 are provided as the occasion demands. That is, the curving rails 25 may be directly coupled to the second backward guide rails 16*b*. Further, a pair of curving rail may be inserted between the first tilt guide rails 21 and the first forward guide rails 15*a* in order for the first guide rollers 12 to move smoothly. Likewise, a pair of curving rails may be inserted between the second tilt guide rails 22 and the second forward guide rails 16*a* in order for the second guide rollers 13 to move smoothly.

In this embodiment, the first tilt guide rails 21 and the second tilt guide rails 22 and 23 are arranged so that the first and second guide rollers 12 and 13 are simultaneously guided downward by the first and second tilt guide rails 21, 22 and 23, or the second guide rollers 13 are guided by the second tilt guide rails 22 and 23 just before the first guide rollers 12 are guided by the first tilt guide rails 21. If the arrangement fails to meet such condition, the steps 10 may interfere with each other or overhang of the locus 37*a* may increase. As a result, the depth of the upper frame of the conveyer apparatus 1 may increase.

Figure 12:
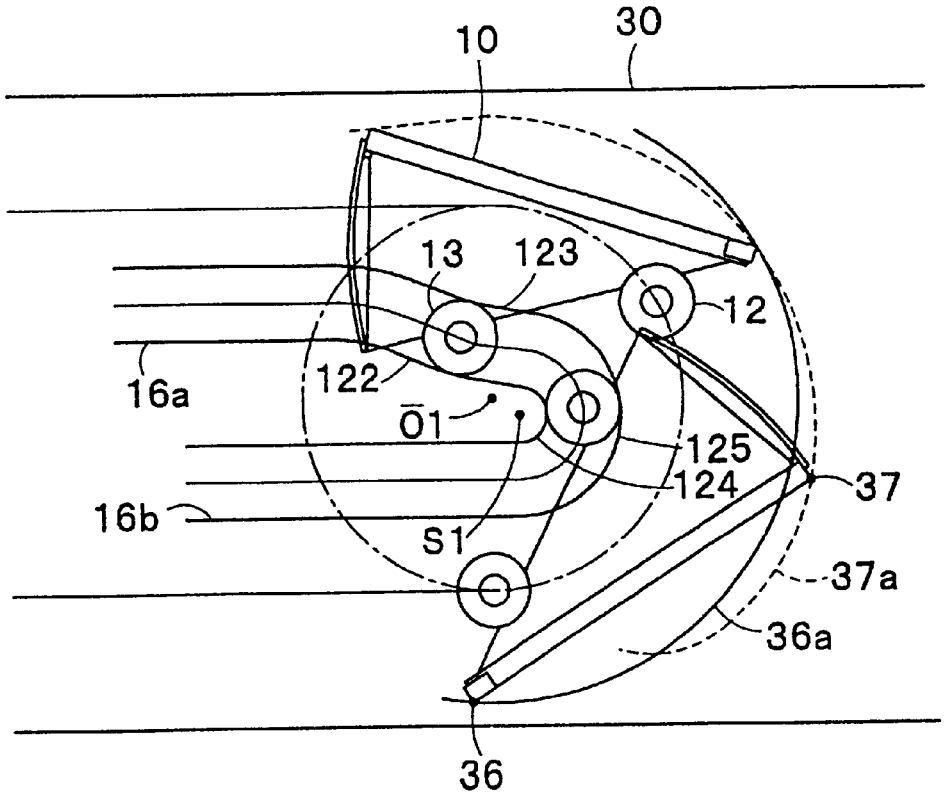
FIG. 12 is a side view of an upper fame portion of the passenger conveyer apparatus of the third embodiment of the present invention.
Figure 13:
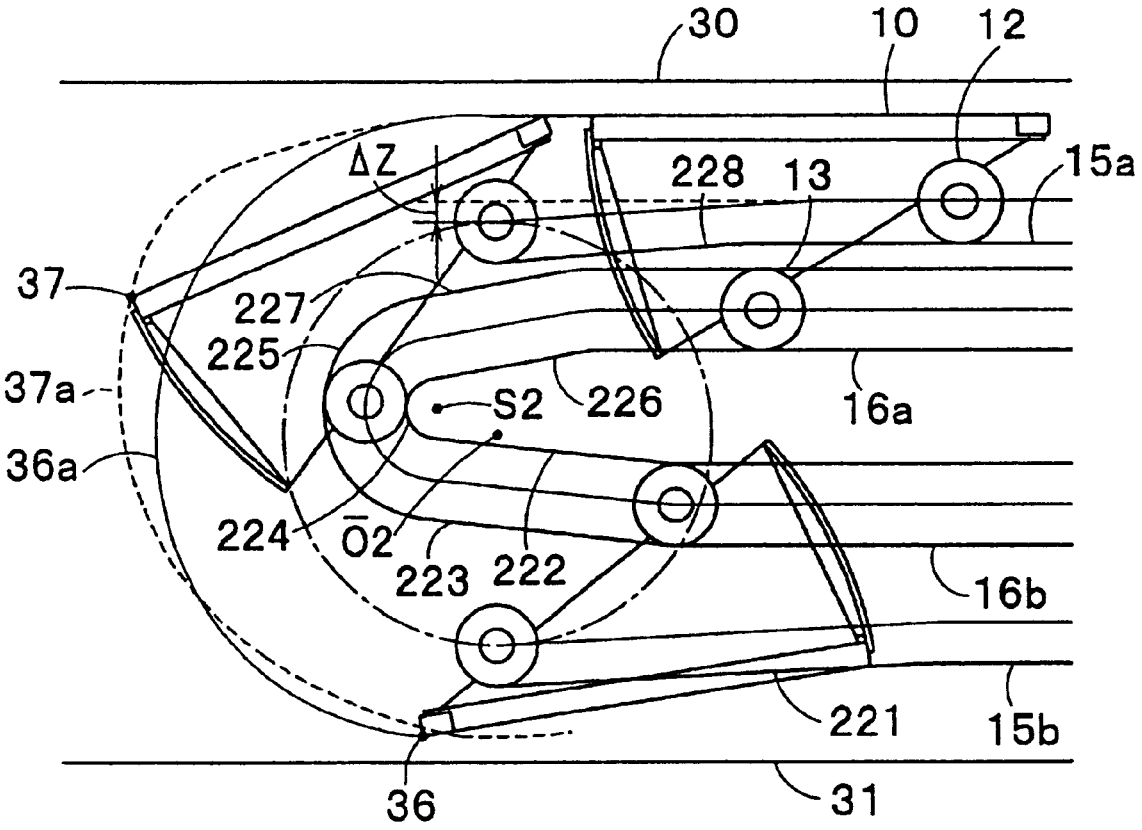
FIG. 13 is a side view of a lower frame portion of the passenger conveyer apparatus of the fourth embodiment of the present invention.

A third embodiment of a passenger conveyer apparatus is hereinafter described referring to FIG. 12 and FIG. 13. FIG. 12 is a side view of an upper frame portion of the passenger conveyer apparatus of the third embodiment of the present invention. As shown in FIG. 12, in one side of the turning systems, the conveyer apparatus 1 includes two pairs of curving rails 124 and 125 formed in a semicircle for leading the second guide rollers 13 along the semicircular orbit, and pairs of second tilt guide rails 122 and 123 formed in S-shape for moving the second guide rollers 13 nearer to the orbital center. In the third embodiment, the rails 122, 123, 124 and 125 are substituted for the turning rails 16*c* and 16*d* in the fist embodiment.

The second tilt guide rails 122 and 123 consist of convex portions disposed on the side of the second forward guide rails 16*a* and concave portions, thereby being formed in S-shape. The second tilt guide rails 122 and 123 guide the respective bottom and upper sides of the second guide rollers 13. The curving rails 124 and 125, which are continuously coupled to the second tilt guide rails 122 and 123, guide the respective bottom and upper sides of the second guide rollers 13 in the same way. Further, the curving guide rails 125 are coupled to the second backward guide rails 16*b*. An orbital center "S1" of the curving rails 124 and 125 is shifted apart from the center "O1" of the step chain sprockets 14 toward the end of the conveyer apparatus 1 in accordance with the arrangement of the rails 122 through 125.

Further, in one side of the turning systems shown in FIG. 12, the rear edge 37 travels inside a locus 36*a* of the front edge 36 in a forward side section (upper side section) of the turning path, and then travels outside the locus 36*a*. In a backward side section (lower side section) of the turning path, the rear edge 37 travels inside the locus 36*a*. That is, the step 10 turns over in the turns path so that the loci 36*a* and 37*a* made by the respective turning motions of the front and rear edges 36, 37 of the step tread 10*a* cross each other in the forward and backward sides section of the turning path.

The other components of the conveyer apparatus 1 of the third embodiment are the same as the first embodiment in FIG. 6 through FIG. 9. In the third embodiment, a detailed explanation of the same components as the first embodiment is omitted by giving the same numerals to the corresponding components.

According to the third embodiment, since the second guide rollers 13 move downward along the concave portions of the second tilt guide rails 122 and 123, a gap between the loci 36*a* and 37*a* becomes greatly smaller, thereby reducing overhang of the locus 37*a* of the rear edge 37 and a distance between the step 10 and the floor 30. As a result, the depth of the upper frame of the conveyer apparatus 1 may reduce, Effect obtained by reducing the distance between the step 10 and the floor 30 may be improved by setting the gap between the center O1 and the orbital center S1 properly, The above-mentioned tug system may be adopted for the other side of the turning systems. However, it is preferable to adopt the following turning system shown in FIG. 13 for avoiding an upward overhang of the front edge 36. A fourth embodiment of a passenger conveyer apparatus is hereinafter described referring to FIG. 13. FIG. 13 is a side view of a lower frame portion of the passenger conveyer apparatus of the fourth embodiment of the present invention. In the fourth embodiment, the conveyer apparatus 1 includes pairs of curving rails 224 and 225 formed in a semicircle for leading the second guide rollers 13 along the semicircular orbit, a pair of second lower tilt guide rails 222 and 223 for moving the second guide rollers 13 nearer to the orbital center, pairs of second upper tilt guide rails 226 and 227, a pair of first lower tilt guide rails 221 for guiding the first guide rollers 12 and a pair of first upper guide rails 228 for guiding the first guide rollers 13.

The rails 226, 227 and 228 are substantially parallel to each other in order to move the steps 10 for a length of $\Delta Z$ in the vertical direction. The rails 222, 223, 226 and 227 guide the bottom and upper sides of the second guide rollers 13. The curving rails 224 and 225, which are coupled between the second lower tilt guide rails 222 and 223, and the second upper tilt guide rails 226 and 227, guide the bottom and upper sides of the second guide rollers 13 likewise. The second upper tilt guide rails 226 are connected to ends of the second forward guide rails 16*a*. The second lower tilt guide rails 223 are connected to ends of the second backward guide rails 16*b*. The first upper tilt guide rails 228 are connected to the first forward guide rails 15*a* The first lower tilt guide rails 221 are connected to the first backward guide rails 15*b*. An orbital center "S2" of the curving rails 224 and 225 is shifted apart from the center "O2" of the step chain sprockets 14 toward the end of the conveyer apparatus 1 in accordance with the arrangement of the rails 221 through 228.

In the turning path of the lower frame, since the steps 10 move in the vertical direction in a condition of keeping a horizontal posture thereof, a gap between the loci 36*a* and 37*a* becomes greatly smaller, thereby reducing overhang of the locus 36*a* of the front edge 36 and a distance between the step 10 and the floor 30. As a result, the depth of the lower frame of the conveyer apparatus 1 may reduce. The effect obtained by reducing the distance between the step 10 and the floor 30 may be improved by setting the gap between the center O2 and the orbital center S2 properly.

The turning system described in the fourth embodiment may be adopted for the passenger conveyer apparatuses 1 in the first, second and third embodiments. Although escalators are illustrated in the above embodiments, the tuning systems in the above embodiments may be adopted for the moving walkways.

According to the invention, since the steps turn over in the turning path so that the loci made by the respective tug motions of the front and rear edges of the step tread of the step cross each other, a gap between loci made by respective turning motions of the front and rear edges of the step and a radius of gyration of the steps may be reduced. As a result, the depth of the main frame including the turning system and the construction costs for installing passenger conveyer apparatus may be reduced.

Various modifications and variations are possible in light of the above teachings. Therefore, it is to be understood that within the scope of the appended clams, the present invention may be practiced otherwise than as specifically described herein.

What is claimed is:

1. A passenger conveyer apparatus, comprising:

a plurality of steps, connected to each other in an endless loop, traveling on a forward path, a backward path and a pair of turning paths connecting between opposite ends of said forward path and said backward path, each of said steps comprising a step tread and first and second guide rollers offset from each other in the traveling direction of said steps;

a step chain coupled to said steps and placed around a step chain sprocket disposed in one of said turning paths;

a drive unit configured to drive said step chain sprocket and to circulate said steps;

a forward rail configured to guide said first and said second guide rollers in said forward path;

a backward rail configured to guide said first and said second guide rollers in said backward path; and a pair of turning rails configured to guide said second guide roller in said turning paths, each turning rail having a curving rail formed in an arc, wherein at least one of said turning rails is formed in a manner such that a line segment drawn between an orbital center of a corresponding curving rail and a first center of said first guide roller makes an acute angle with a line segment drawn between said orbital center and a second center of said second guide roller, and a loci made by respective turning motions of front and rear edges of said step tread cross each other.

2. The passenger conveyer apparatus as recited in claim 1, wherein said orbital center is offset from a center of said step chain sprocket in a direction towards a respective one of said opposite ends of said passenger conveyer apparatus.

3. The passenger conveyer apparatus as recited in claim 1, wherein a distance between said first center and said second center is approximately half a width of said step tread measured in the travelling direction of said steps.

4. The passenger conveyer apparatus as recited in claim 3, wherein said forward rail includes a first forward rail configured to guide said first guide roller and a second forward rail configured to guide said second guide roller, said first forward rail including an upper guide rail configured to guide the upper side of said first guide roller and a lower guide rail configured to guide the bottom side of said first guide roller.

5. The passenger conveyer apparatus as recited in claim 1, further comprising:

a riser secured to one edge of said step tread, a bottom of said second guide roller being level with a lower end of said riser.

6. The passenger conveyer apparatus as recited in claim 5, wherein said forward rail includes a first forward rail configured to guide said first guide roller and a second forward rail configured to guide said second guide roller, said first forward rail including an upper guide rail configured to guide the upper side of said first guide roller and a lower guide rail configured to guide the bottom side of said first guide roller.

7. The passenger conveyer apparatus as recited in claim 1, further comprising:

a tilt guide rail configured to move said steps nearer to said orbital center and connected between said forward rail and said curving rail.

8. The passenger conveyer apparatus as recited in claim 7, wherein said tilt guide rail includes a first tilt guide rail configured to guide said first guide roller and a second tilt guide roller configured to guide said second guide roller, and said first and second guide rollers are simultaneously guided by said first and second tilt guide rails.

9. The passenger conveyer apparatus as recited in claim 7, wherein said tilt guide rail includes a first tilt guide rail configured to guide said first guide roller and a second tilt guide rail configured to guide said second guide roller, and said second guide roller is guided by said second tilt guide rail before said first guide roller is guided by said first tilt guide rail.

10. The passenger conveyer apparatus as recited in claim 7, wherein said tilt guide rail is formed in an S-shape.

* * * * *